US005355818A

United States Patent [19]

Strait et al.

[11] Patent Number: 5,355,818

[45] Date of Patent: Oct. 18, 1994

[54] PORTABLE INSPECTION EQUIPMENT FOR OCEAN GOING VESSELS

[75] Inventors: Gary Strait; Paul Murphy, both of San Pedro, Calif.

[73] Assignee: Strait Imaging Research, Newport Beach, Calif.

[21] Appl. No.: 936,208

[22] Filed: Aug. 27, 1992

[51] Int. Cl.[5] ..... B63G 8/00

[52] U.S. Cl. ..... 114/73; 114/221 R

[58] Field of Search ..... 114/74 A, 74 R, 74 T, 114/75, 76, 221 R, 222, 73; 405/185; 354/64; 352/131, 132

[56] References Cited

U.S. PATENT DOCUMENTS

| | | | |
|---|---|---|---|
| 3,863,393 | 2/1975 | Goff | 114/222 |
| 3,864,876 | 2/1975 | Diehn | 114/222 |
| 4,163,455 | 8/1979 | Herbert | 114/222 |
| 4,502,407 | 3/1985 | Stevens | 114/222 |

*Primary Examiner*—Stephen P. Avila
*Attorney, Agent, or Firm*—Plante, Strauss & Vanderburgh

[57] ABSTRACT

There is disclosed an inspection device which can be disassembled into a compact configuration permitting it to be moved into and out of the cargo and ballast tanks of an ocean going vessel through the conventional hatches. The invention comprises a carriage support column which is formed by several cables which are stretched vertically between support plates which are temporarily installed on the bottom of the tank or cargo hold and beneath the vessel's decking. A carriage is mounted on the support column for vertical movement thereon, and the carriage preferably carries a remotely controlled drive motor which can rotate the carriage, preferably in a full 360° arc. A remotely controlled television camera and the necessary lights are mounted on the carriage and can be panned around the column to observe and record the visual appearance of the interior structural members. In another embodiment of the invention, the support column is a mast which is constructed from individual mast components which are assembled at the bottom of the cargo hold and are fed upwardly through a mast support until the mast reaches the under surface of the deck, where the upper end of the mast is temporarily secured.

27 Claims, 10 Drawing Sheets

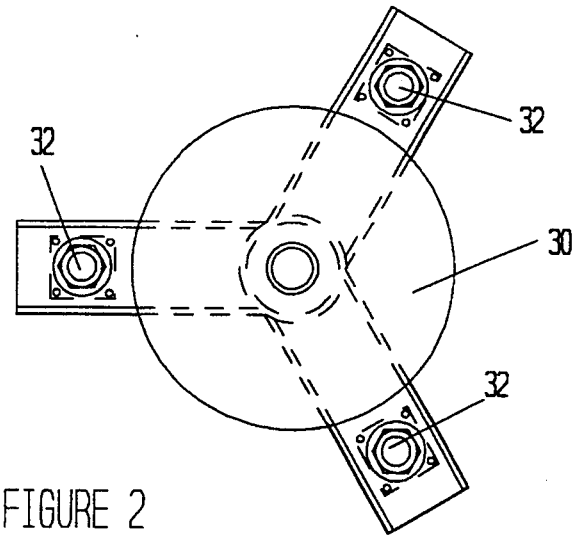
FIGURE 2
FIGURE 3
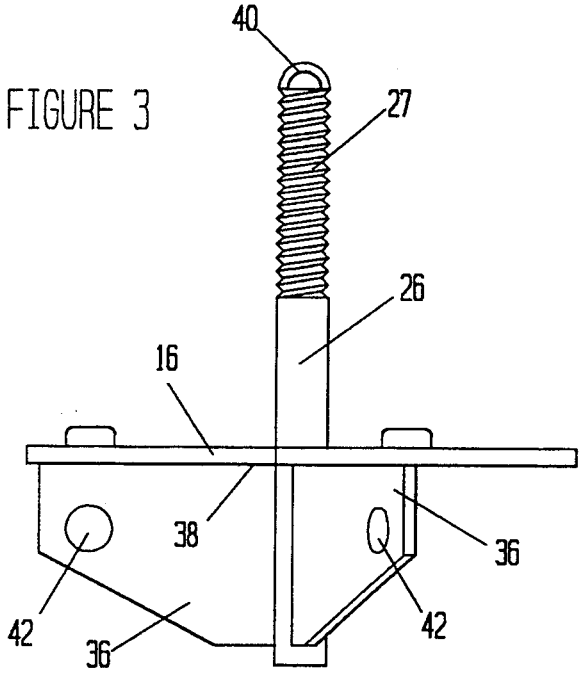

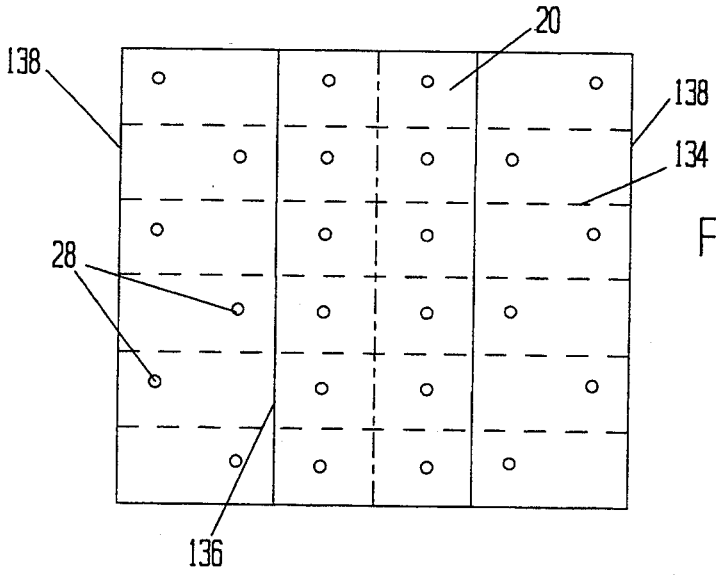
FIGURE 5
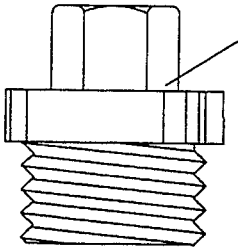
FIGURE 6
FIGURE 7
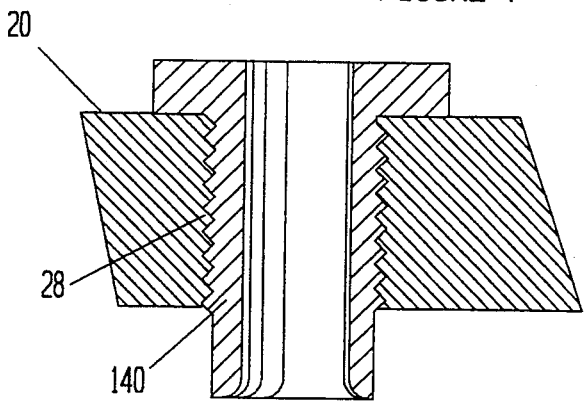

PORTABLE INSPECTION EQUIPMENT FOR OCEAN GOING VESSELS

FIELD OF INVENTION

This invention relates to an inspection device and, in particular, to a portable inspection device suitable for installation in the interior sections of a vessel for inspection thereof.

BRIEF STATEMENT OF THE PRIOR ART

The interior structural members of ocean going vessels must be inspected periodically to determine the condition of the steel and coatings so that necessary preventive maintenance can be taken to prevent failure from corrosion, fatigue cracking, and the like. While various techniques and equipment have been suggested for the inspection, the customary method is by visual inspection of all the interior surfaces of the tanks. This has required construction of scaffolding within the tanks. A recently introduced technique is to suspend scaffolding from the from transverse and longitudinal stiffening adjacent the undersurface of the main deck plating.

The construction of scaffolding and the requirement to visually inspect all the interior surfaces causes the inspection to be very tedious and time consuming, often requiring that a vessel be out of service for a considerable period of time for the inspection.

The inspection is also quite hazardous as the inspectors must climb scaffolding and, often, climb the interior structural members along the sides and bulkheads of the vessel. As these internals are often coated with oil and silt, the footing is not secure. Workers have been injured during the inspection by slipping or falling from the internal structural members.

OBJECTIVES OF THE INVENTION

It is an objective of this invention to provide an inspection apparatus which can be assembled within the vessel and which has an inspection platform that can be raised and lowered within the vessel.

It is a further object of this invention to provide a carriage that supports a worker, or a remotely controlled inspection device such as a television camera, whereby the entire interior surface of a tank may be inspected remotely.

It is also an object of this invention to provide azimuth controls whereby the direction of a remote camera can be controlled thereby permitting the camera to pan over the entire interior surface of a tank of an ocean going vessel.

It is a further object of this invention to provide an inspection apparatus that can be assembled and disassembled within an ocean going vessel.

It is an objective of the invention to provide a plurality of access holes in the decking of an ocean going vessel at appropriate locations to permit installation and use of inspection apparatus.

It is also an objective of the invention to provide a platform lift mechanism which can be installed within the vessel.

It is further an objection of the invention to provide a remote station on a vessel to operate the inspection equipment and make observations on the condition of the interior structural members.

Other and related objects will be apparent from the following description of the invention.

BRIEF DESCRIPTION OF THE INVENTION

This invention comprises an inspection device which can be disassembled into a compact configuration permitting it to be moved into and out of the cargo and ballast tanks of an ocean going vessel through the conventional hatches.

The preferred embodiment of the invention comprises a carriage support column which is formed by several cables which are stretched vertically between support plates which are temporarily installed on the bottom of the tank or cargo hold and beneath the vessel's decking. A carriage is mounted on the support column for vertical movement thereon, and the carriage preferably carries a remotely controlled drive motor which can rotate the carriage, preferably in a full 360° arc. Preferably, a remotely controlled television camera and the necessary lights are mounted on the carriage and can be panned around the column to observe and record the visual appearance of the interior structural members.

In another embodiment of the invention, the support column is a mast which is constructed from individual mast components which are assembled at the bottom of the cargo hold and are fed upwardly through a mast support until the mast reaches the under surface of the deck, where the upper end of the mast is temporarily secured.

BRIEF DESCRIPTION OF THE DRAWINGS

FIG. 2 is a plan view of the jacking plate used in the invention;

FIG. 3 is a side view of the upper support plate used in the invention;

FIG. 5 illustrates the arrangement of inspection access holes in the deck of a ship for use with the inspection device of the invention;

FIG. 6 is an elevational sectional view of a closure plug used in the deck apertures;

FIG. 7 is an elevational sectional view of the deck apertures shown in FIG. 5;

FIG. 10 illustrates the take up spools used with the alternative inspection device;

DESCRIPTION OF PREFERRED EMBODIMENTS

Figure 1:
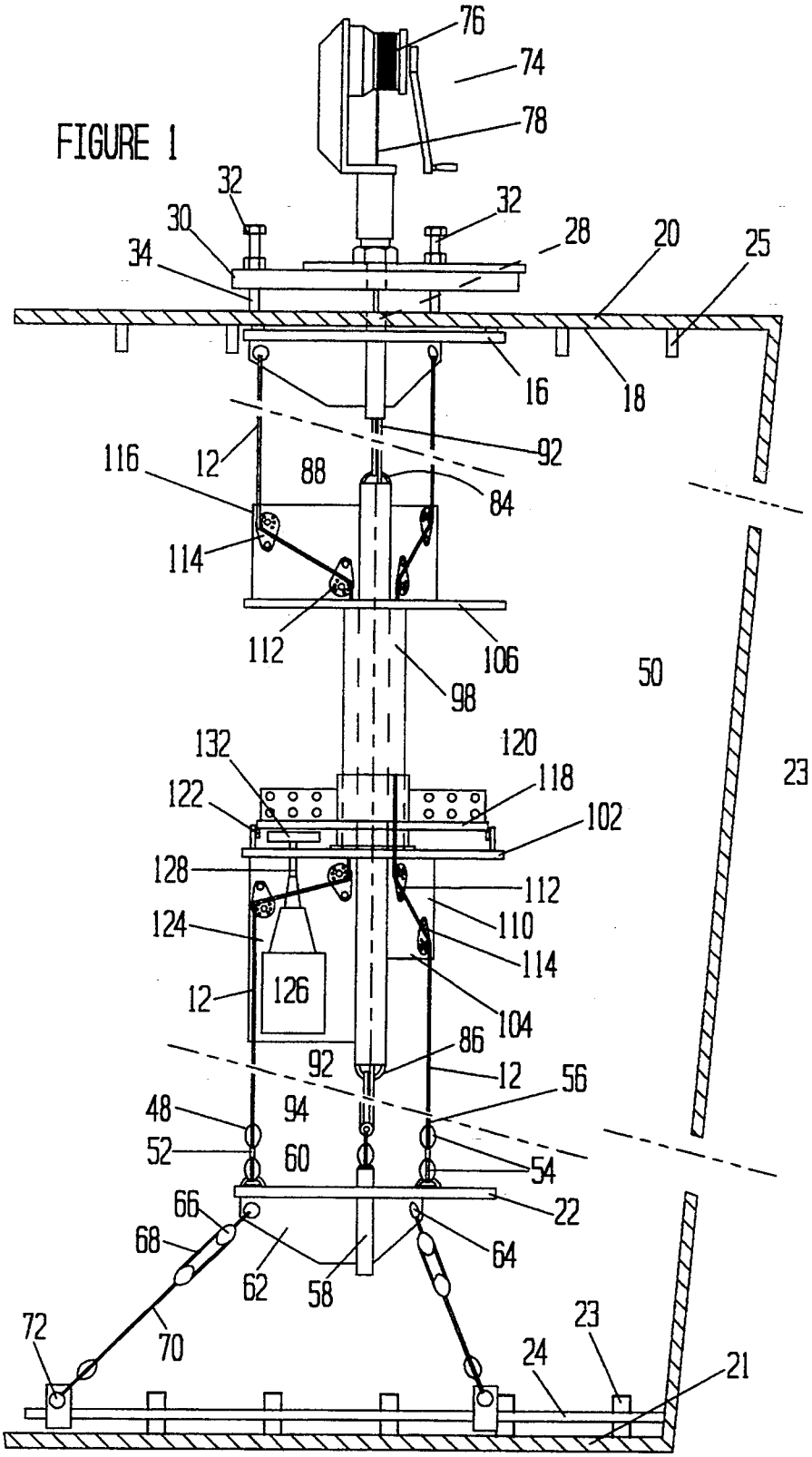
FIG. 1 is an elevational view of the interior of a vessel with the invention installed in an inspection configuration.

The inspection device of the invention is used for inspection of the surfaces of the interior of ocean going vessels, which typically have internal tanks. As shown in FIG. 1, a tank is formed between the main decking 20 and the bottom shell 21 of the vessel. At least one side of the tank usually is formed by the vessel sidewall 23 and the opposite side can be a longitudinal bulkhead or, in some instances, can be opposite interior sidewall of the vessel. The tanks are separated by bulkheads and are reinforced with upper and lower frame structural members 24, e.g., stiffeners. Additionally, a plurality of longitudinal stiffeners extend the length of the ship such as the top longitudinal stiffeners 25 and the bottom longitudinal stiffeners 23. Additionally, although not shown, a plurality of stiffening ribs are also present on the opposite side walls and on the bulkheads of the vessel.

In a typical ocean going vessel, a single interior tank can have interior dimensions of from 20 to 60 feet in width, from 30 to 90 feet in height and from 20 to 200 feet in length. The tanks have access openings, or hatches, which are typically 24 to 36 inches in diameter, and all equipment and personnel must enter the tanks through these hatches.

The inspection device 10 of invention comprises a plurality of guy wires 12 which form a track support for a vertically movable inspection carriage 14. The guy wires 12 are secured in the interior of the vessel, extending from an upper support plate 16 which is temporarily affixed to the underside 18 of the decking 20 and a bottom support plate 22 which is temporarily secured to structural members 24 adjacent the bottom wall or shell of the vessel.

The upper support plate 16 has a central column 26 (see FIG. 3) which extends through an aperture 28 appropriately located in the ship's decking 20 and through an aligned aperture centrally located in a jacking plate 30 which is mounted topside on the decking 20. The jacking plate 30 has a plurality of jacks 32 disposed at its extremities, preferably three jacks are disposed at equal 120° angular spacings; see FIG. 2. The jacks 32 are conventional jacks having mechanical lead screws 34; alternatively, hydraulic or pneumatic cylinders can be used. The jacks 32 provide variable and controlled extendibility permitting leveling of the jacking plate 30 and adjustment of the tension of the guy wires 12 which extend vertically between the support plates 16 and 22.

As shown in FIG. 3, the upper support plate 16 has stiffening ribs 36, preferably three are disposed at equal 120° angular spacings on the under surface 38 of the plate 16. A central column 26 extends through the upper support plate 16 and has a distal tang 40. The stiffening ribs 36 have apertures 42 at their outer, lower corners, which provide fastening means for the upper ends 44 (see FIG. 1) of the support column guy wires 12. The upper support plate column 26 extends through aligned apertures in the deck and jacking plate; see FIG. 1. Preferably, the support column 26 has external threads 27 and receives a nut 46 for completing the assembly of the upper support plate 16 and jacking plate 30.

The lower ends of the support column guy wires 12 are secured by fastening means 48 carried at appropriate peripheral locations on the bottom support plate 22 and are tensioned between the support plates 16 and 22 to form the support column on which the carriage 50 is movably supported. In the illustration, three guy wires 12 make up the support column and these guy wires are disposed at equal 120° angular spacings. The support column guy wires 12 extend vertically and are tensioned with suitable means such as turn buckles 52 which are located in the pairs of blocks 54 which comprise the attachment means between the lower ends 56 of the guy wires 12 and the bottom support plate 22.

The bottom support plate 22 is anchored to structural members 24 at the bottom of the vessel. The plate 22 has a central column 58 which, at its upper end carries a tang 60. The column 58 extends below the plate 22, and a plurality of stiffening ribs 62 are welded to the column and the underside of the plate 22. Preferably the ribs 62 are disposed at equal 120° angular spacings and have fastening means in the form of apertures 64 which receive a conventional block 66 of a block subassembly 68 which includes an adjustable pair of blocks with a cable 70 which extends to clamps 72 that are secured to a structural member such as a stiffening member 24 of the vessel. The clamps 72 can be permanently installed or can be removably attached as desired.

A winch 74 is mounted on the jacking plate 30. The winch 74 has a drum 76 on which a lift cable 78 is stored for raising and lowering of the inspection apparatus 10. The cable 78 is played downwardly through the aligned holes of the jacking plate 30 and upper support plate 16 to the bottom of the vessel and attached to the tang 40 (FIG. 3) of the upper support plate 16 during installation of the inspection apparatus 10, permitting the winch operator to raise the support column assembly within the vessel. When the support column assembly is in its upper position and its lower end is secured by the bottom support plate 22, the nut 46 is advanced on the central column 26 of the upper support plate 16 and the jacks 32 are elevated as required to level the jacking plate 30. Final tension adjustment can be made with the turn buckles 52 adjacent the lower or bottom support plate 22.

Figure 4:
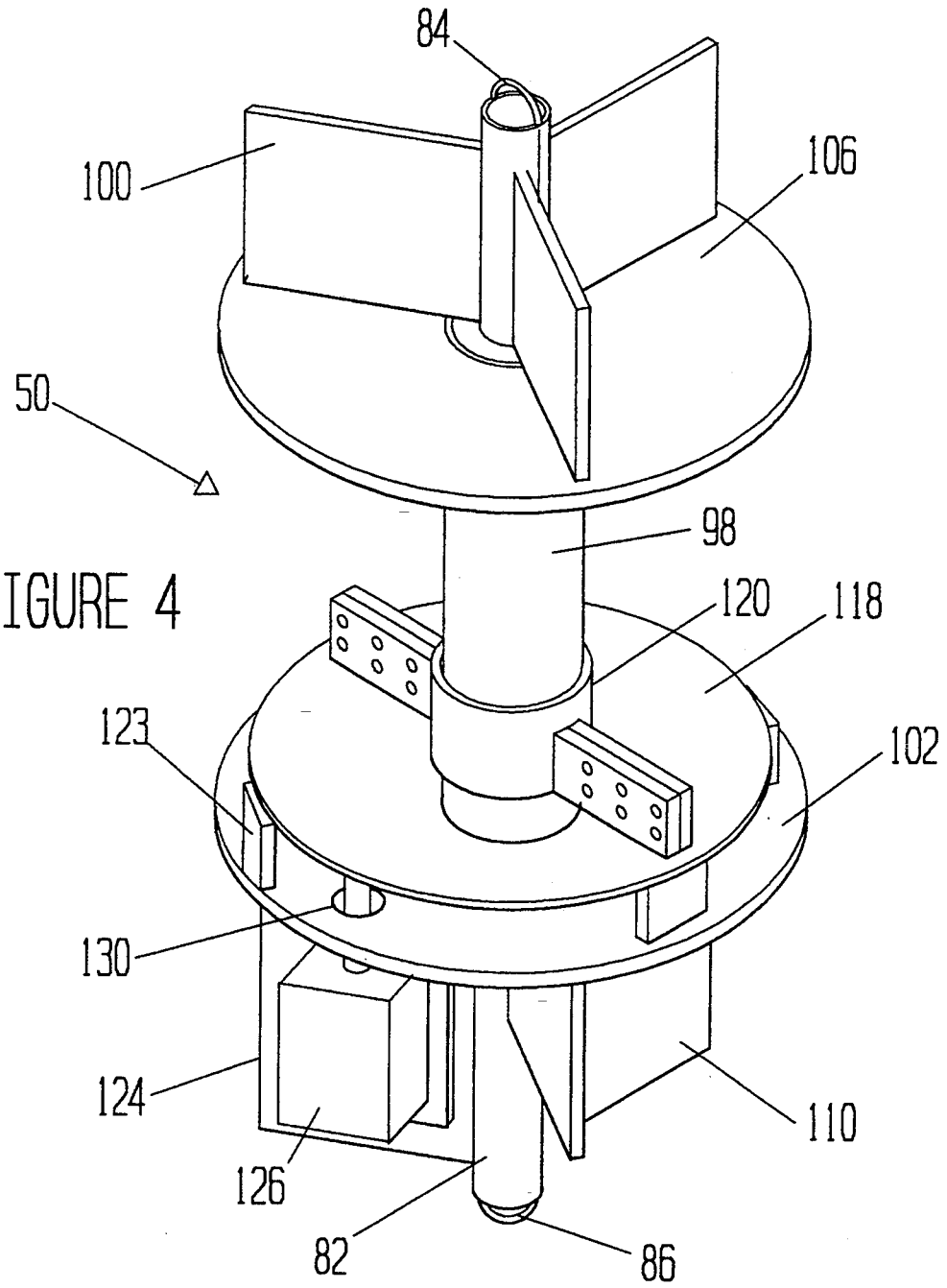
FIG. 4 is a perspective view of the carriage used in the inspection device.

The inspection device 10 also includes a movable carriage 50 which is vertically or elevationally movable on the guy wires 12 which form the support column. The carriage 50 is shown in perspective view in FIG. 4, and in an operative position in FIG. 1. The carriage 50 has a central support column 82 distally bearing an upper tang 84 and a lower tang 86. One end 88 of a carriage elevational cable 90 is attached to the upper tang 84 of the carriage support column 82 and its opposite end 92 is attached to the lower tang 86 of the support column 82. As shown in FIG. 1, the elevational cable 90 is extends about the winch drum 76 and extends downwardly to a block 94 having a bail and turn buckle 96 which is secured in tang 60 on the upper end of the central column 58 of the bottom support plate 22. The elevational cable 90 is played over the block 94 and then extends vertically into attachment to the lower tang 86 on the carriage support column 82. In this construction it is apparent that the support column 82 can be readily raised or lowered by moving of the elevational cable 92.

The carriage 50 is rotatably mounted on the support column 82 and, for this purpose, has a center sleeve 98 concentrically received over the carriage support column 82 with its lower end attached to a carriage support plate 102. The upper end of the center sleeve 98 is attached to an upper carriage plate 106. Upper stiffening ribs 108 are welded to the top side of the upper carriage plate 106, and similar ribs 110 are welded to the under surface of the carriage support plate 102. Preferably the stiffening ribs 108 and 110 are located at equal, 120° angular increments. Each of the stiffening ribs carries a pair of idler mechanisms 112 (FIG. 1) comprising blocks with appropriate pulleys.

Pairs of idler blocks 112 are located at opposite ends of diagonals of the stiffening ribs, with the outermost idler blocks 114 being at the upper edges 116 of the ribs 108 and at the lower edges 104 of the stiffening ribs 110 on the carriage support plate 102. The guy wires 12 of the support column are played over the pairs of idler blocks 112 and 114 to direct the guy wires 12 through the center sleeve 98 of the carriage 50, beside the support column 82. In this manner, the carriage 50 is vertically movable on the guy wires 12 and is rotationally restrained thereon.

The carriage 50 also includes a rotatably mounted platform 118 which has a central sleeve 120 that is rotatably received over the center sleeve 98 of the carriage 50 and is supported on the carriage support plate 102 by a plurality of rollers 122 (see FIG. 1) which are peripherally disposed about the support plate 102 by supports 123.

Preferably, the carriage 50 also includes motive means for rotationally moving the carriage platform. For this purpose, one stiffening rib 124 on the undersurface of the carriage support plate 102 is vertically extended and an electric motor 126 is fastened thereto with its drive shaft 128 extending vertically through an aperture 130 in the carriage support plate 102. At its upper end the shaft is geared to a horizontal rotatable roller 132 (FIG. 1) on which the rotatably mounted platform 118 rests, so that the motor 126 is capable of rotatably moving the platform 118 on the carriage support plate 102.

A remote controlled television camera (not shown) is carried on the platform 118, preferably one having auto focusing capability and the television camera is panned around the hold by remote actuation of the motor 126. Preferably, the television camera includes a magnification calibration so that the video frame at any given time includes a distance scale so that the true extent and nature of any surface imperfections can be readily observed on the monitor which preferably is located on the deck of the ship.

Access to the hold is necessary during the installation of the inspection system to place the system within the hold, locating it beneath the appropriate inspection aperture 28 and to secure the bottom support plate 22 to the bottom wall or structural members 24 within the vessel. Thereafter the elevation and securing of the support column can be accomplished by operation of the winch 74 above the decking 20.

The decking 20 of the ship is provided with a plurality of access apertures 28 which are located in a predetermined array; see FIG. 5 for a typical arrangement. As shown in FIG. 5, the longitudinal frame members 134 of the vessel appear in broken lines, and the transverse frame members 136 and side shells 138 of the vessel appear in solid lines. FIG. 7 is a sectional view through a typical access aperture 28, and shows an internal sleeve 140 which is inserted to prevent fraying of the inspection device support cables. The aperture 28 is internally threaded and the sleeve 140 is externally threaded as shown. A plug 142, shown in FIG. 6, is also provided and is inserted to close the aperture 28 when the sleeve 140 is removed, thereby closing the aperture 28.

Figure 8:
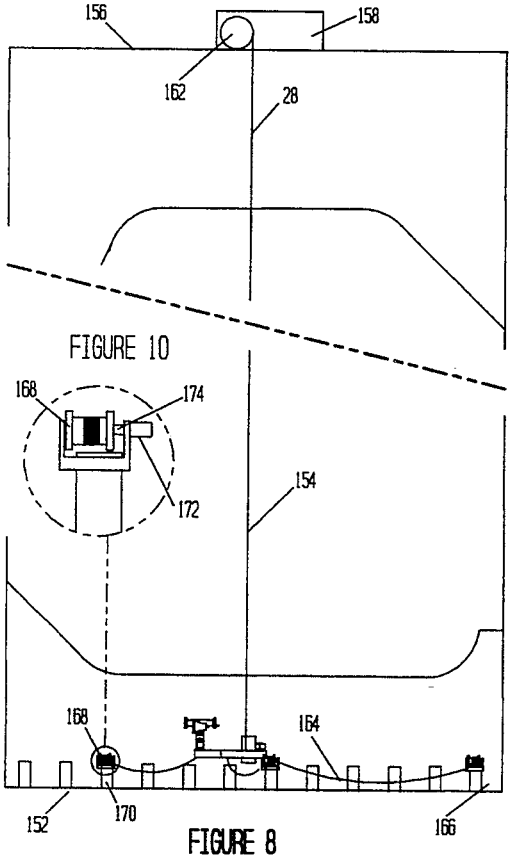
FIG. 8 is an elevational view of an alternative inspection device during its installation in the interior of a vessel.

Referring now to FIG. 8, an alternative inspection device 144 will be described. The illustration shows an inspection platform 146 and remote inspection equipment such as a video camera 148 and lighting 150 at the bottom of the vessel 152, ready for installation. In this application the inspection device 144 is lifted and lowered with a cable 154 which extends through an access aperture 28 in the deck 156. A powered wench 158 is mounted on the deck 156 and the lift cable 154 extends through the aperture 28 in the deck 156 to the bottom of the vessel 152, where it is attached by a support bracket 160 on the platform 146 of the remote inspection device 144.

Figure 9:
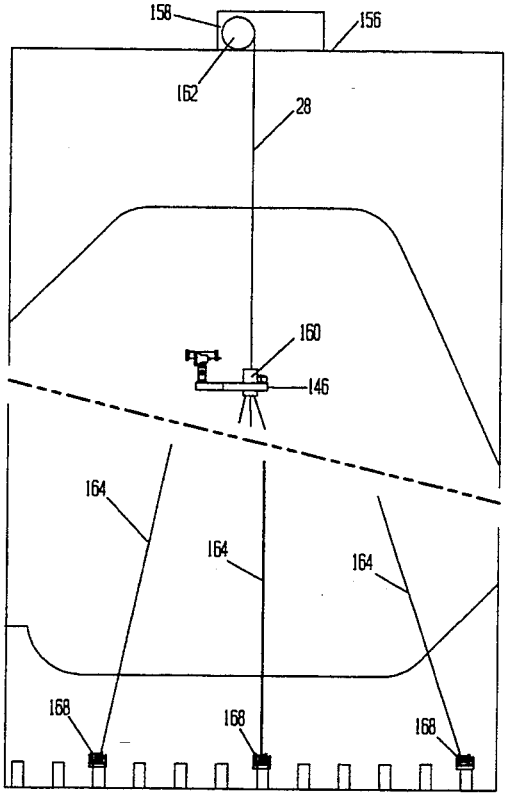
FIG. 9 illustrates the alternative inspection device in use.

The platform 146 of the device 144 is raised by taking up the cable 154 on the drum 162 of the wench 158, in the manner illustrated in FIG. 9. A plurality, e.g., three, tether cables 164 are provided and are attached to the outer lower edges of the platform 146. These tether cables 164 extend to the interior floor 166 of the vessel where they are wound on spools 168, which are clamped to structural members, such as floor stiffeners 170 with a suitable clamp means. As shown in FIG. 10, the spools 168 have a drive motor 172 and gearing 174 to maintain the desired tension on the tether cables 164, and the spool drive motors 172 can be actuated by control signals from a remote control station.

Figure 11:
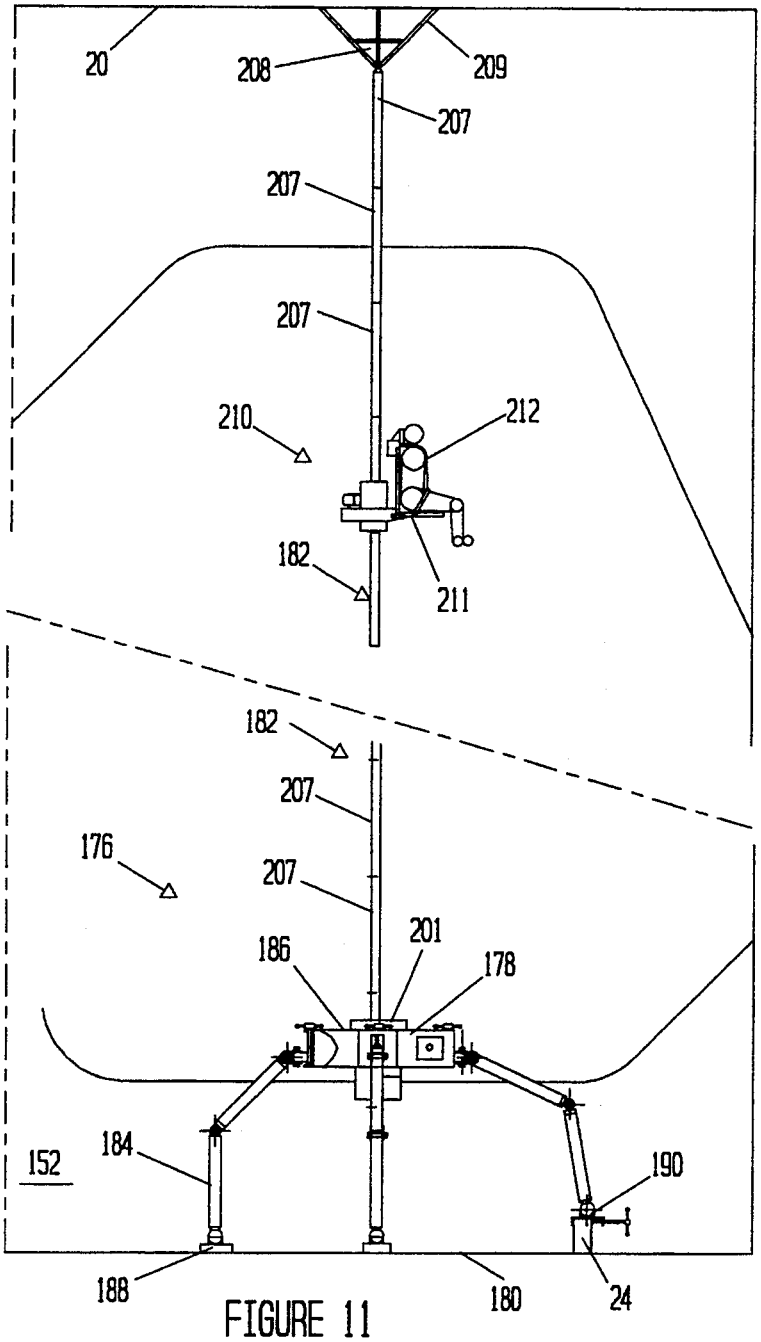
FIG. 11 is an elevational view of the interior of a tank with a second alternative inspection device of the invention installed in an inspection configuration.

Referring now to FIG. 11, an alterative inspection device 176 is illustrated. FIG. 11 is a sectional view through the tank of an ocean going vessel 152. The inspection device 176 is shown in its installed configuration, with the support base 178 resting on the bottom shell 180 of the vessel 152, and with a support mast 182 extending to the roof of the tank, underside of decking 20. For this purpose, the support base 178 has a plurality of legs 184 which are supported from a central platform 186. The legs 184 fold into a compact configuration sufficient to permit installation into and removal of the support base 178 from the vessel 152 through the conventional hatch. The individual legs 184 distally support pads 188 and/or clamps 190 which are useful to rest on the bottom shell 180 or on structural members 24, rigidly securing the base 178 within the vessel 152.

Figure 13:
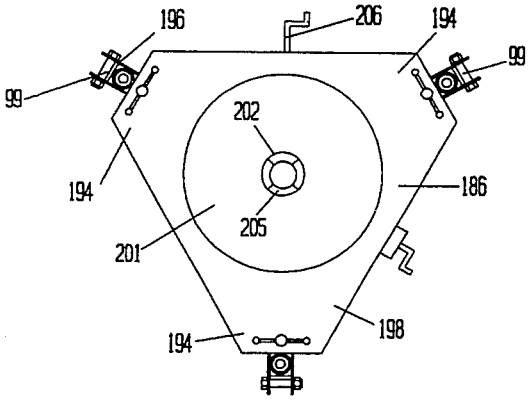
FIG. 13 is a view along lines 13—13' of FIG. 12.
Figure 14:
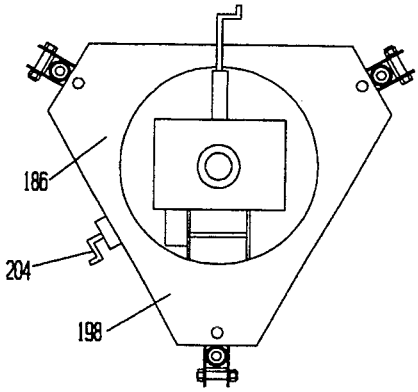
FIG. 14 is a view along line 14—14' of FIG. 12.
Figure 12:
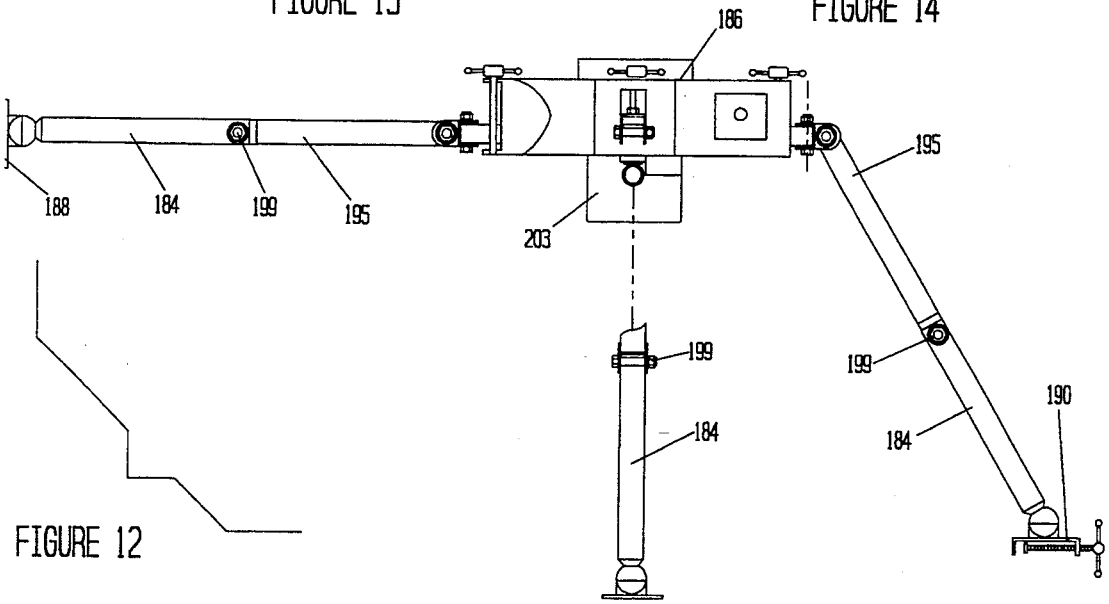
FIG. 12 is an elevational view of the support base of the device shown in FIG. 11.

The support base 178 is shown in greater detail in FIGS. 12 through 14. The support base 178 has a generally triangular platform 186 (see FIGS. 13 and 14) with three support legs 184, forming a tripod. The support legs 184 are pivotally mounted to the support base by mounting brackets 192 which extend from each truncated corner 194 of the triangular base 178 and which have a clevis 196 to pivotally receive the upper ends 198 of each of the legs 184 with a single upper bolt fastener 99. The brackets 192 can be pivotally supported on the platform 198 of the base 178, as desired for maximum flexibility and adaptability of the base for mounting.

The legs 184 can be telescoping tubes if desired. More preferably, the legs are articulated with one upper end 198 and pivotally attached lower ends 197 secured by a single bolt 199.

Each leg 184 distally supports a foot which, as previously mentioned, can have a pad 20 for mounting on a flat horizontal surface, or which can, optionally, be provided with a clamp, such as fastener 200 to permit securing the lower end of the leg 184 to a rib, longitudinal stiffener, and the like.

Referring now to FIG. 13, there is illustrated a view of the top surface of the support base platform 186. The platform 186 centrally supports a rotatable table 201 which has a central cylindrical clamp 202 that clamps a tubular component section of the mast, described hereinafter. The rotatable table 201 is driven by a suitable gear drive coupled to an electric motor within an explosion-proof motor housing 203, all supported on the undersurface of the platform 186, as shown in FIG. 12. It is also desirable to provide a hand crank 204 on the platform 186 for manual operation of the table 201 as shown in FIG. 14.

The clamp 202 has a tubular feeding mechanism for elevating the tubular support mast 182 which comprises at least one driven roller 205 that resiliently biases against the outer surface of the tubular mast 182 and that is in a driven configuration through a suitable gear drive and coupled to a drive motor, also enclosed within an explosion proof housing. Additionally, a manual feed system for elevation of the mast is provided and a hand crank 206 is supported on the platform 186 for manual raising and lowering of the mast 182 of the inspection device 176.

Referring again to FIG. 11, the inspection device 176 of the invention is shown with the platform 186 supporting a support mast 182 that extends the full height of the tank. As described hereinafter, the mast 182 is formed of separate mast component sections 207, each of which is coupled to the lower end of the preceding component section by a suitable joint, e.g., bayonet joint, threaded joint, etc. To permit assembly of the mast, the platform 186 of the support base 178 is located a sufficient distance above the bottom shell 180 so that the tubular component sections 207 can be placed beneath the support base 178 and coupled to the lower end of the last component section 207 secured in the support base 178 and then raised by the mast elevation mechanism on the platform 186 to accept another subjacent or successive tubular component section 207.

At its upper end, the support mast 182 bears a bracket 208 which, preferably, is also a tripod and includes three legs 209 projecting outwardly from the bracket 208 carried on the upper end of the mast. The legs 209 distally carry pads (not shown) which can be compressed against the under surface of the decking 20 in a tight compressive fit.

The support mast 182 serves as a vertical track for a movable carriage 210 that can support various elements. As illustrated in FIG. 11, the carriage 210 supports s a bosun's chair 211 on which an inspector 212 can sit and thus be elevated the entire height of the tank for a visual inspection of the tank surfaces. As with all of the inspection devices of this invention, the carriage 210 can be rotated a full 360° to control the azimuth or orientation of the carriage 210. Preferably the rotation of the carriage 210 is accomplished by rotation of the rotary table 201 on the platform 186, previously described.

Figure 16:
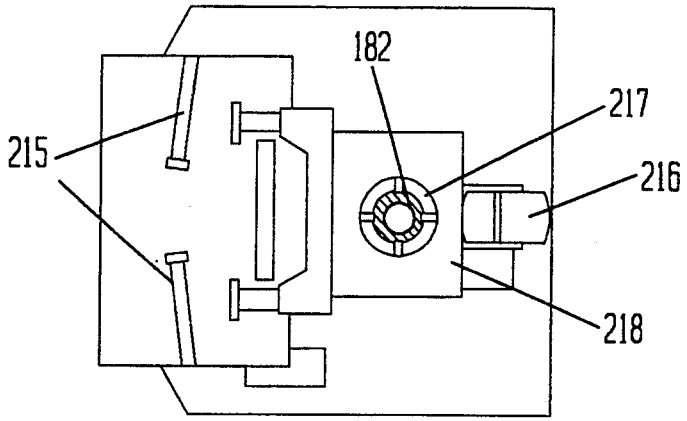
FIG. 16 is a side elevational view of a carriage with a remotely controlled camera and lighting.
Figure 15:
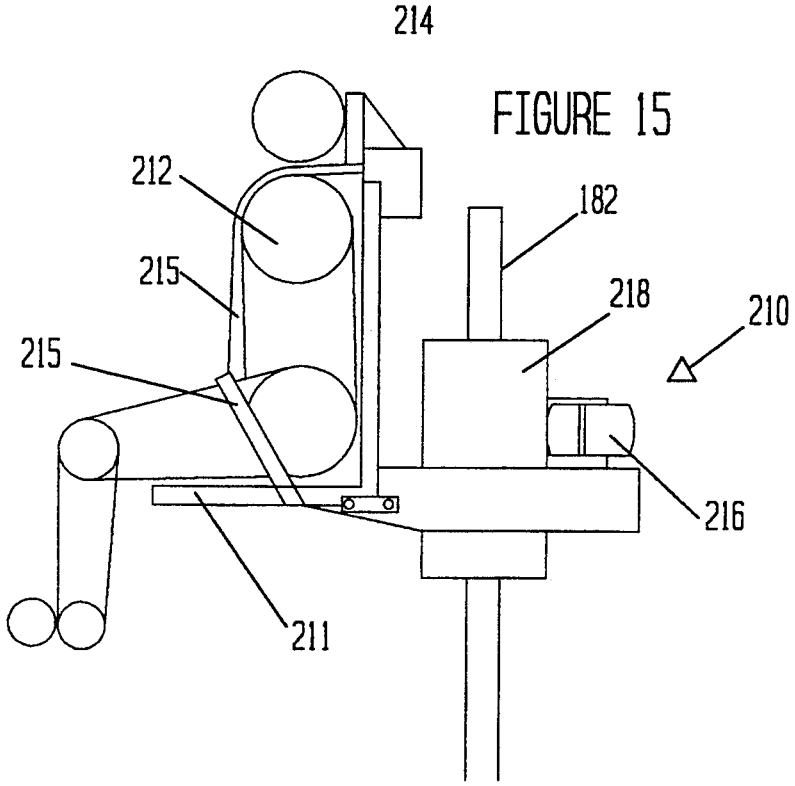
FIG. 15 is an elevational view of the carriage used in the device of FIG. 11.

Referring now to FIGS. 15 and 16, the carriage 210 will be described. As previously mentioned, the carriage 210 supports a bosun's chair 211 with a seat having a back rest 213 and head rest 214 with seat belts 215 to restrain the inspector 212 (occupant) in the bosun's chair 211. The carriage 210 is provided with a drive motor in an explosion-proof housing 216 to control its vertical travel on the support mast 182 and, for this purpose, a plurality of drive rollers 217, having arcuately concave surfaces are provided about the mast 182 which is centrally received in the assembly. The rollers 217 resiliently grip the mast and are driven through a gear box 218 by the motor within housing 216 on the carriage 210. Suitable controls are provided adjacent the bosun's chair 211 to permit the inspector 212 to control the vertical movement of the carriage 210 and, through either an umbilical cord or radio frequency transmitter/receiver to also control the rotational movement of the mast 182 and carriage.

Figure 19:
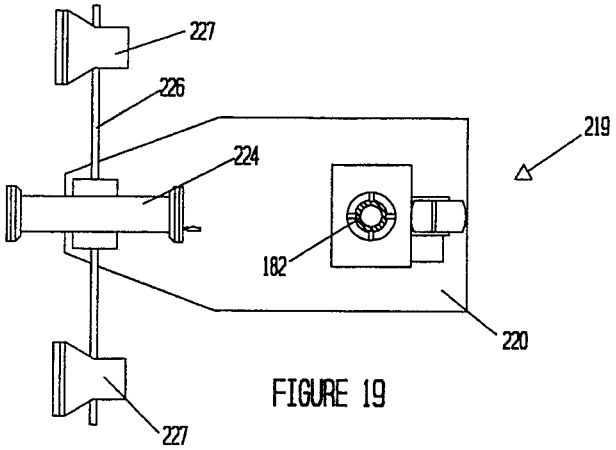
FIG. 19 is a plan view of the carriage of FIG. 16.
Figure 17:
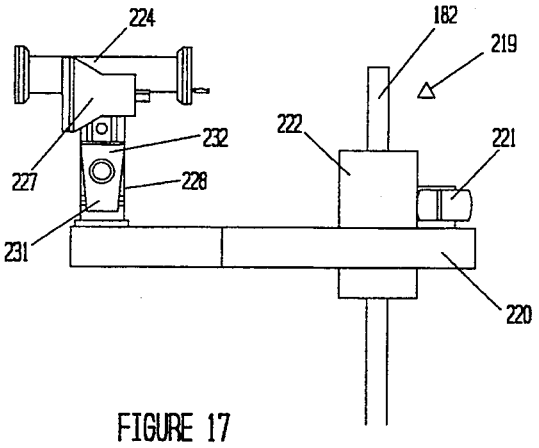
FIG. 17 is a plan view of the carriage of FIG. 16.
Figure 18:
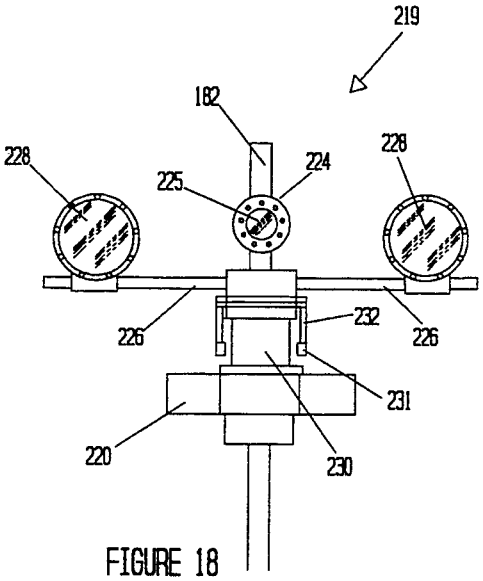
FIG. 18 is a front view of the carriage of FIG. 16.

Referring now to FIGS. 17–19, the inspection device can be provided with a traveling carriage 219 that carries a remotely controlled camera and lighting mechanism. For this purpose, the carriage 219 has a substantially flat platform 220 that supports the lights and camera mechanism. The platform 220 of the carriage 219 supports a drive motor 221 and a gear box 222 with driven rollers 223 on the mast 182, all as previously described. In this application, however, the platform 220 supports a camera and lighting mechanism which includes a remotely controlled television camera that is housed in a tubular camera housing 224 which is preferably sealed to provide an explosion-proof assembly and which has a transparent window 225; see FIG. 18. The mechanism has outboard poles 226 that laterally support a pair of floodlights which are also within explosion-proof housings 227 covered by transparent plates 228. Preferably, the camera and light mechanism is mounted on a bracket 228 which can be rotationally secured to the support pedestal 230 that is attached to the platform 220 on a vertical pivotal axis and the bracket 228 can be counterbalanced with a weights 231 on counterbalance arms 232. When the camera and light support pedestal is rotationally supported on the platform it provides a pan function as well as the camera tilt function achieved by bracket 228, previously described. All of these functions can be controlled with an internal drive motor (not illustrated), which is coupled through a suitable gear train to the rotational pedestal and the bracket of the mechanism.

Figure 21:
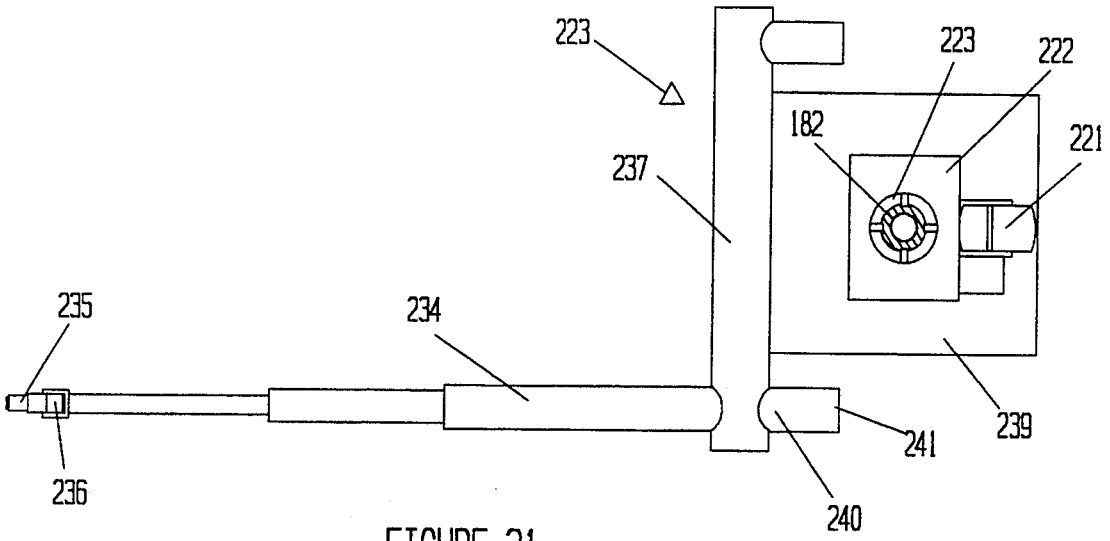
FIG. 21 is a plan view of the camera carriage of FIG. 20.
Figure 20:
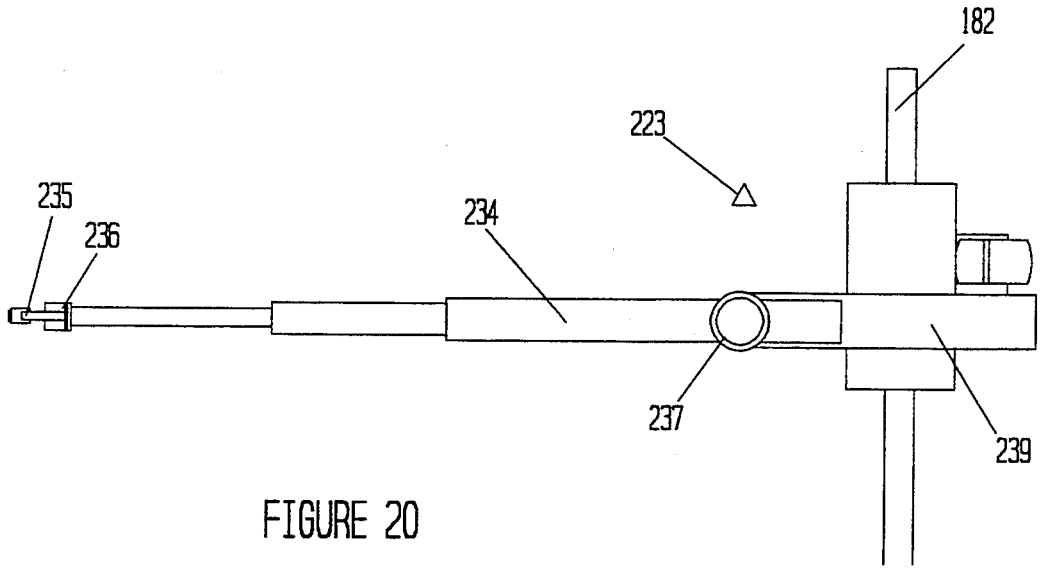
FIG. 20 is an elevational view of an alternative camera carriage.

Referring now to FIGS. 20 and 21, another embodiment of the invention will be described. As there illustrated, a carriage 233 is provided which has a telescoping arm 234 which distally supports a miniature television camera 235. The camera 235 is distally supported on the end 236 of a telescoping arm 234. The telescoping arm 234 is carried on the end of a support shaft 237 that is journaled along one edge 238 of the platform 239 of the carriage 233. The shaft 237 preferably has a pair of arms 240 which are counter balanced with weights 241. The carriage platform 239 has the same elevational drive motor 221 and gear box 222 and driven rollers 223 previously described to control the vertical movement of the carriage 233 on the mast 182. Additionally, the carriage carries, within the journal housing 242, a drive motor (not shown) which controls the rotation of the support shaft 237, thereby controlling the tilt of the camera 235 and also the extension of the telescoping arm 234, thus controlling the proximity of the television camera 235 to the surface under inspection and enabling close-up views as well as large fields of view.

The remote controls can be connected to an operator control station at the base of the support platform. The remote controls can be coupled with an umbilical cord to the control station or, preferably, are linked thereto by suitable radio frequency, preferably, frequency modulated radio signals with a transmitter at the control station and a receiver on the platform controlling the movement of the elevational drive motor as well as the motors which control the tilt and pan of the remote camera. Preferably, the control station is also provided with a monitor and the cameras used are television cameras which transmit a signal back to the monitor so that the operator is constantly in touch with the object being viewed and photographed by the camera and being recorded on the film for the camera or the video tape when video recording facilities are used.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. The combination of a ship having a cargo hold beneath the deck of said ship and accessible for cleaning and inspection through a cargo hatch of limited dimensions and an inspection device comprising:

a. carriage support means comprising a plurality of spaced-apart guy wires received within said cargo hold and including attachment means removeably securing said guy wires in a vertical position including first attachment means to secure the upper ends of said guy wires to said deck and second attachment means to secure the lower ends of said guy wires to the bottom wall of said cargo hold;

b. a carriage vertically moveably received on said guy wires;

b. a platform rotationally mounted on said carriage for rotational movement thereon and including a central column;

c. means to direct said guy wires into and through said central column;

d. carriage elevational drive means to raise and lower said carriage on said guy wires.

2. The combination of ship and inspection device of claim 1 wherein said carriage has a support column received within said central column and wherein said elevational drive means comprises cable means attached to the upper end of said support column to raise said carriage, and attached to the lower end of said support column to lower said carriage.

3. The combination of ship and inspection device of claim 2 wherein said plurality of guy wires are attached at their upper ends to an under deck support plate, and at their lower ends to a bottom support plate and wherein said first attachment means removeably secures said under deck support plate to the underside of said deck and said second attachment means removeably secures said bottom support plate to the bottom of said hold.

4. The combination of ship and inspection device of claim 1 wherein said plurality of guy wires comprise three guy wires located at 120 degrees incremental azimuth spacings.

5. The combination of ship and inspection device of claim 1 wherein said second support means includes lower guy wires extending between said lower support plate and the bottom of said hold.

6. The combination of ship and inspection device of claim 3 wherein said inspection carriage supports a pair of pulley blocks for each respective guy wire, and said guy wires extend over and about said pulley blocks to deflect said guy wires into said support column whereby said carriage is elevationally moveable thereon.

7. The combination of ship and inspection device of claim 2 wherein said elevational drive means includes a winch secured to said deck and wherein said cable means comprises a lift cable extending centrically downwardly with one end attached to the upper end of said support column and its opposite end attached to the lower end of said support column.

8. The combination of ship and inspection device of claim 7 including bottom block means centrally located on the upper surface of said bottom support plate and wherein said lift cable extends about bottom block.

9. The combination of ship and inspection device of claim 1 wherein said upper attachment means comprises a support plate having a central column on its upper surface, and wherein said deck has a deck aperture and including a jacking plate mounted on the top of said deck and having a central aperture which is aligned with said deck aperture, with said central column received through said aligned apertures and including means to removeably secure said central column to said jacking plate.

10. The combination of ship and inspection device of claim 9 wherein said jacking plate includes vertically adjustable jacks located at lateral extremities thereof in load bearing support on the top of said deck.

11. The combination of ship and inspection device of claim 10 wherein said support column distally carries a cable tang and including a second lift cable extending from said winch through said aligned apertures and secured to said cable tang for lifting said carriage support means.

12. The combination of ship and inspection device of claim 11 wherein said carriage elevational drive means comprises cable means attached to the upper end of said support column to raise said carriage, and attached to the lower end of said support column to lower said carriage.

13. The combination of ship and inspection device of claim 12 wherein said carriage includes a carriage platform having a central column rotatably received over said central carriage column.

14. The combination of ship and inspection device of claim 13 wherein said carriage includes a platform support plate secured to said support column and having a plurality of support rollers peripherally located thereon and said carriage platform moveable rests thereon.

15. The combination of ship and inspection device of claim 14 wherein said carriage includes platform drive motor means for rotational moving said carriage platform.

16. The combination of ship and inspection device of claim 15 wherein said platform drive motor means is supported by the undersurface of said platform support plate, which removeably receives said central column,

17. The combination of claim 5 including remote inspection means carried on said carriage and including inspection panning means on said carriage to control the azimuth of said inspection means, whereby said inspection means can be directed at any interior surface of said hold.

18. The combination of claim 17 wherein said inspection means is a television camera.

19. The combination of claim 18 wherein said television camera is supported on a pole which is movably supported on said carriage with remote means carried on said carriage to extend and withdraw said pole whereby the proximity of said camera to the side walls of said cargo hold can be varied.

20. The combination of a ship having a cargo hold accessible for cleaning and inspection through a cargo hatch of limited dimensions and an inspection device comprising:

a. a support spider comprising a central support collar with at least three legs located about said collar and pivotally attached thereto to permit said support spider to collapse to a compact configuration permitting its installation and removal through said hatch of limited dimensions;

b. a column support centrally carried on said support spider and comprising clamp means to rigidly secure a column component thereto;

c. a plurality of column components, each having a limited length to permit introducing said components beneath said support spider to attach to the lower end of a column component supported thereon; and d. elevation means on said support spider and operatively connected to said column support whereby said column may be elevated to raise the column the length of the lowermost column components and permit attachment of a succeeding column component, whereby a column extending substantially the entire height of said cargo hold may be assembled within said hold.

21. The combination of claim 20 wherein said legs are telescoping legs.

22. The combination of claim 20 including support appendages on said legs comprising pads or clamps.

23. The combination of claim 20 including a carriage movably mounted on said column and including a self supported drive means operatively coupled to said column for vertical movement thereon.

24. The combination of claim 23 wherein said drive means comprises at least one roller resiliently bearing against said column and a drive motor operatively connected to said roller.

25. The combination of claim 24 including remote inspection means carried on said carriage and including inspection panning means on said carriage to control the azimuth of said inspection means, whereby said inspection means can be directed at any interior surface of said hold.

26. The combination of claim 25 wherein said inspection means is a television camera.

27. The combination of claim 26 claim 7 wherein said television camera is supported on a pole which is movably supported on said carriage with remote means carried on said carriage to extend and withdraw said pole whereby the proximity of said camera to the side walls of said cargo hold can be varied.

* * * * *